US005792262A

United States Patent [19]

Bohn et al.

[11] Patent Number: 5,792,262

[45] Date of Patent: Aug. 11, 1998

[54] PROCESSING TOOL FOR PROCESSING PLY MATERIAL OR THE LIKE

[75] Inventors: Martin Bohn, Reutlingen; Wolfgang Scheller, Oberpleichfeld, both of Germany

[73] Assignee: bielomatik Leuze GmbH & Co., Germany

[21] Appl. No.: 742,410

[22] Filed: Nov. 4, 1996

[30] Foreign Application Priority Data

Nov. 21, 1995 [DE] Germany ..... 195 43 316.5

[51] Int. Cl.[6] ..... B05C 1/00

[52] U.S. Cl. ..... 118/244; 118/60; 118/256; 118/DIG. 15; 101/389.1

[58] Field of Search ..... 118/200, 244, 118/256, DIG. 15, 60, 46; 101/389.1; 492/8; 399/279, 277, 330, 333

[56] References Cited

U.S. PATENT DOCUMENTS

| | | | |
|---|---|---|---|
| 3,496,866 | 2/1970 | Nystrand . | |
| 3,721,189 | 3/1973 | Bray | 101/389.1 |
| 4,638,281 | 1/1987 | Baermann | 399/279 |

FOREIGN PATENT DOCUMENTS

| | | | |
|---|---|---|---|
| 325 535 | 7/1989 | European Pat. Off. . | |
| 2 474 954 | 8/1981 | France . | |
| 1 029 101 | 4/1958 | Germany . | |
| 19 16 145 | 10/1969 | Germany . | |
| 2231452 | 1/1973 | Germany . | |
| 2230703 | 1/1974 | Germany . | |
| 2329680 | 1/1974 | Germany . | |
| 1381468 | 1/1975 | United Kingdom | 101/389.1 |
| 9309952 | 5/1993 | WIPO | 101/389.1 |

*Primary Examiner*—Laura Edwards
*Attorney, Agent, or Firm*—Quarles and Brady

[57] ABSTRACT

A plate cylinder (1) for applying hot glue to a paper web comprises distributed circumferentially in a regular pattern a plurality of separate magnet units (22) oriented radially, extending up to its circumferential surface (18) and temperature-resistant up to at least 300° C. which radially oriented outwards like the substantially tubular tool base body (15) are heated and serve to retain one or more separate, flexural letterpress plates.

25 Claims, 1 Drawing Sheet

PROCESSING TOOL FOR PROCESSING PLY MATERIAL OR THE LIKE

BACKGROUND OF THE INVENTION

1. Field of the Invention

The invention relates to a tool with which in particular planar paper or film-like material can be processed e.g. by providing or impressioning a planar side with a coating or the like precisely defined.

2. Description of Related Art

The tool comprises at one of its ends, e.g. to be defined in a machine frame or movably mounted in bearings, a base body so that it is capable of implementing a relative working movement in a working direction with respect to the material, the frame or the like, particularly a rotary movement about its longitudinal axis. The paper web or the like may thus be guided along the circumference of the tool tensioned full-length and processed thereby in the region of a working nip between the tool and a companion tool on the fly.

In the case of such tools it is expedient to mount tool or processing inserts, such as planar plate inserts, replaceable so that the tool can be reequipped for differing processing work, particularly without it needing to be demounted. If the tool is operated at working temperatures exceeding 50°, 100° or 150° C. in the region of the working zone, as is the case for example in plating a hot-glue coating or self-adhesive film, reliable retention of the insert may become a problem, when the positive retaining forces against lifting of the base body coming from an energy storage are formed substantially only by forces which attract the insert against the base body, as is for example the case of fluid suction forces, magnetic forces or the like. With increasing temperatures namely the retaining force may strongly diminish, in the case of permanent magnets as of the so-called Curie temperature, at which a ferromagnetic material loses its magnetism and which is specific or different for magnets of differing material. However, for reliable retention of one or more inserts mutually spaced in or transversely to the working direction it is necessary to maintain the retaining force substantially constant at all working temperatures arising.

It is contemplatable to provide in the base body transversely to the working direction and parallel to the working or working nip plane full-length parallel longitudinal grooves and to insert therein magnet units of rectangular cross-section, including pole plates or shieldings and thus determining a preferred direction directly adjoining longitudinally and to define them by bonding. In such an arrangement it is difficult to assure the temperature resistance of both the magnetization and of the bonding. At high peripheral velocities of the working zone or of the base body magnet parts may thus release from their retention and from the remaining tool due to centrifugal forces which results in severe damage. The peripheral velocity is, however, required to be at least 100 or 140 m/min.

SUMMARY OF THE INVENTION

The invention is based on the objects of defining a tool in which the drawbacks of known configurations or of the kind described are avoided. Further objects may involve preventing even at high temperatures of the interengaging retention surfaces any appreciable diminishment in the retaining forces oriented transversely to the retention surfaces, to permit speedy replacement of the processing inserts and to assure a simple configuration of the tool.

In accordance with the invention the tool or the retention means is/are configured for operation at temperatures of at least 100° to 120° C. in the region of the retention means or surfaces thereof, this temperature being expediently even at least 160° to 180° C., at least 200° to 250° C., at least 300° to 350° C. or in excess of 400° C.

For the magnet units juxtaposed in the longitudinal direction of the tool preferably at least two separate mounts penetrating the retention surface of the base body are provided, between which the base body forms directly an intermediate limit or contact surface for the inserts. If the retention force is exerted by suction in the region of this penetration, then the penetrations form suction ports each of which is defined integrally located juxtaposed separately about the circumference. In each mount only one single magnet unit can be arranged with a sole magnet body which may comprise for achieving a preferred extension and orientation of the magnetic field a shield or a pole intensifier. These form expediently a sleeve enclosing the magnetic or field axis continuously and/or the full length of the magnet body continuously or a closed cover at the side of the magnet body facing away from the retention surface. As a result of this, this cover may be connected to the circumference and/or at the face and directly fixedly or over its full surface to the base body thus durably defining the magnet unit without directly coming into contact with adjacent units or being connected thereto. The magnet body has no contact with respect to the base body and the bonding connection.

Although it is contemplatable to configure at least one magnet as a ceramic or barium ferrite magnet, as a ferrous magnet, as a hard ferrite magnet or the like, expediently however such magnets are completely dispensed with and instead an alloy magnet, particularly an aluminum-nickel-cobalt magnet is used which can be made by sintering a powder or by casting and which apart from iron may also contain copper and titanium, enabling the attracting surface of the magnet body to be well machined by grinding or some other machining process and thus to be adapted coincident and flush with the adjacent or directly adjoining surface sections of the base body. The magnet may also contain the elements samarium, neodym and/or boron.

Also, securing each magnet unit to the base body is consistent with respect to the cited temperatures. The magnet unit may be secured in the mount of the base body by a press or shrink fit, screwing or the like, the outer shell surrounding the magnet body, for example, forming a male thread in the longitudinal region enclosing the magnet body which engages a female thread of the mount. The unit may also feature at its end facing away from the attraction surface a threaded mandrel of reduced diameter for axial or positive locking with respect to the base body. A particularly simple configuration materializes, however, when the unit is defined exclusively friction-locking or bondingly with zero clearance with respect to the base body, for instance by means of an anaerobic, non-aging and temperature-resistant adhesive which prior to hardening has such a low viscosity that excess amounts of adhesive on manual insertion of the magnet unit are pressed out flowingly from the mount and producing an adhesive interfilm which is totally free of inclusions or bubbles, the minimum and maximum thickness of which is preferably less than three and two tenths of a millimeter-respectively. The mount may be formed by a cylindrical hole such as a blind hole having a surface roughness Rz of at least 10 or 20, particularly approximately 30. The hardened adhesive is high-temperature resistant in the hardened condition up to one of the cited temperatures, particularly up to 200° C.

The base body may consist in one piece, particularly as a tubular sleeve, of a ferromagnetic material, the contact surface of which can be or is hardened for the insert in each case, for example, by carburizing, so that the base body can be rendered resistant to wear.

The magnet units may be closely arranged over the full length or complete circumference of the base body in a homogenous pattern throughout without contacting each other, having a width of at least 15 or 20 mm with a view to the attraction surface and a length greater than their width. Expediently, each magnet unit is configured cylindrical throughout and multi-part, the individual parts being formed juxtaposed by a surface composition. Relative to the contact surface of the tool as a whole the surface proportion of all attraction surfaces and cross-sections is expediently at least 10 or 15% and not more than 30 or 25 and 20% respectively, particularly approximately 17.5%.

The processing insert comprises to advantage a plate of a ferromagnetic material to be placed in direct contact with the surface of the base body, for example, a flexible plate of sheet metal of less than one or half a millimeter in thickness which is provided on its working side with a continuous, full-length coating, which is thicker with respect to the latter, of a material which as compared to that of the plate is substantially more elastic in compression. This coating may be a plastics material, for example, silicone, and engages the material during processing or transfers the glue to the material by a letterpress method. The insert may be, in addition to the adhesive-acting retention means, defined by positive engagement with respect to the base body parallel to the retention surface, particularly with respect to movements in the working direction, especially by insertion means, the inserting direction of which is located transversely to the retention surface and the members of which may be configured, on the one hand, integral with the insert and, on the other, integral with the base body.

These and further features are evident not only from the claims but also from the description and the drawings, each of the individual features being achieved by themselves or severally in the form of subcombinations in one embodiment of the invention and in other fields and may represent advantageous aspects as well as being patentable in their own right, for which protection is sought in the present.

BRIEF DESCRIPTION OF THE DRAWINGS

An example embodiment of the invention is explained in more detail in the following and illustrated in the drawings in which.

DETAILED DESCRIPTION OF THE PREFERRED EMBODIMENTS

Figures 1, 2, 3, 4, 5:
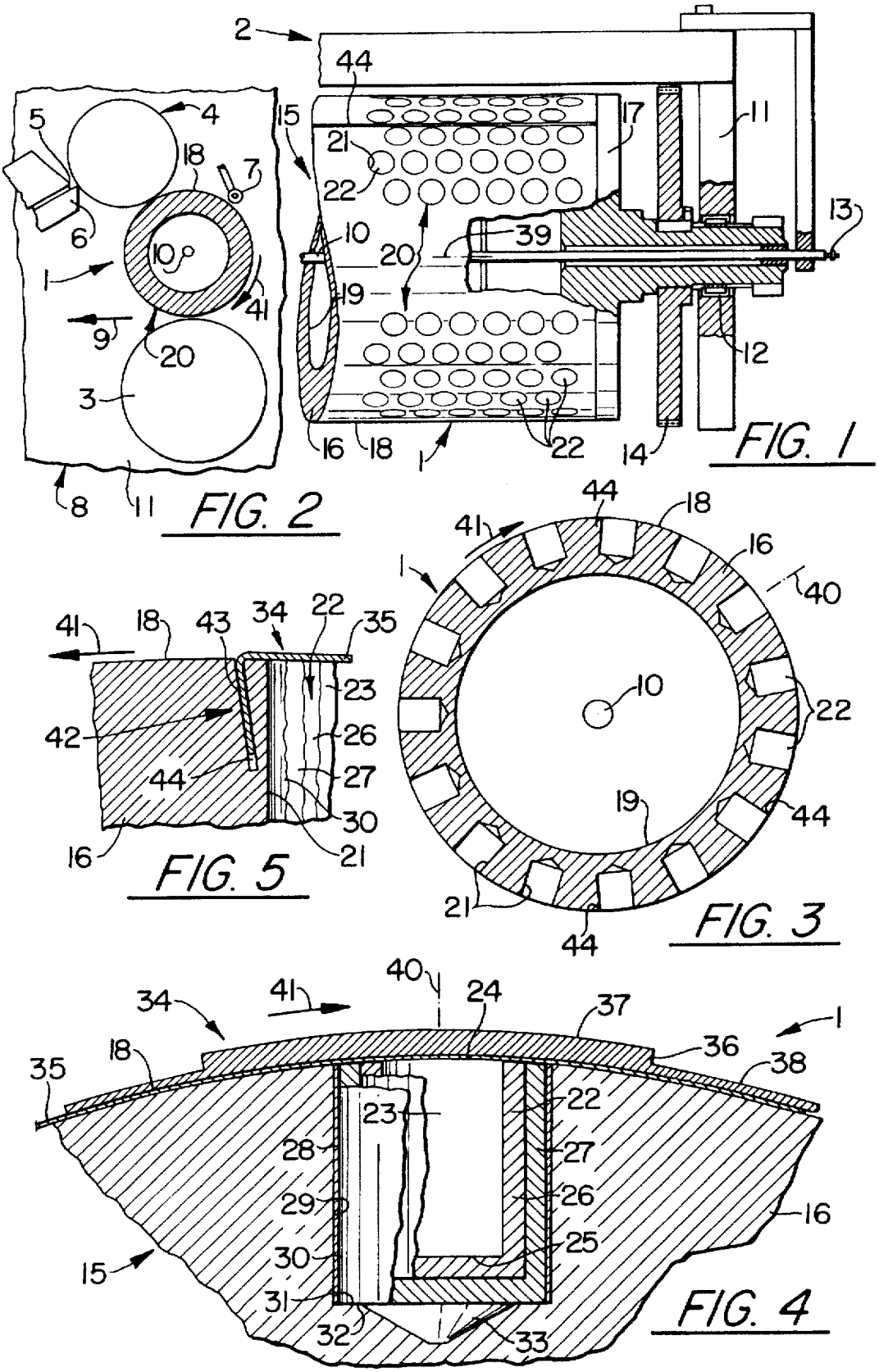
FIG. 1 is a partly sectioned view of a tool in accordance with the invention.
FIG. 2 shows the arrangement of a tool in a machine for processing ply material on the fly.
FIG. 3 is a cross-section through the tool as shown in FIG. 1.
FIG. 4 is a section view of FIG. 3 shown substantially magnified.
FIG. 5 is a section view of FIG. 3 shown further magnified.

The tool 1 in this case is a plate cylinder provided in a device 2 for transferring hot glue to a paper web. The material web may be processed before and/or after such processing and spaced away therefrom in further processing stations following unreeling from a material storage on the fly, the web being maintained tensioned full-length spaced upstream and downstream of the device 2 or of the remaining devices by conveyor means. In the device 2 to be shifted into place on a bottom frame parallel to the tool axis horizontal in its working height, before being locked with respect thereto and thus replaceably arranged in this working position, the material web is conveyed through between the circumferential surface of the tool 1 and that of a companion tool 3 roughly horizontal in the running direction 9, whereby hot glue is rollingly applied to the upper surface as a film on fields which are small with respect thereto. For this purpose the rolls 1, 3 disposed in a vertical axial plane form a passage or working nip for the material web, the upper limit of which is formed by the roll 1.

On the upper surface facing away from the roll 3 an applicator roll 4 runs at the circumference of the tool 1 for the coating material which is supplied spaced away from the point of application with this material by an application nozzle directed at its circumference. The circumferential surface of the applicator roll 4 is porously patterned to receive the application material, namely hot glue applied as a film preheated from the nozzle 5. By means of a knife 6 directly following the nozzle orifice in the direction of rotation the thickness of the application film to the roll 4 is maintained constant and between the circumferential surface and facing surface of the nozzle head a reservoir nip of glue is formed tapered in cross-section extending up to the knife 6 in the direction of rotation. The glue fed to the roll 4 at roughly 160° to 180° C. is transferred following a rotation of less than 180° of 90° to the heated tool 1 and forced onto the paper web by the latter after a rotation of somewhat more than 180° whilst the temperature is maintained in the working nip. For temperature control the temperature at the circumference of the tool 1 is sensed by a temperature sensor, for instance a rolling or proximity-type sensor 7 for subsequent control of a heater 10 located totally within the tool 1 which heats the entire circumferential surface of the tool 1 from the inside outwards.

Each of the preassembled units 1 and 3 to 6 is mounted in the region of its ends at two side cheeks 11 of a device frame 8, where necessary by roller bearings 12, in the region of which also the tool drive is located. The heater 10 is formed by a heater rod located in the center or longitudinal axis 39 of the tool 1 substantially in non-contact therewith which heats the inserts of the tool 1 by radiated heat which is then passed on to the working surface. Outside of one face of the tool 1 or on an outer side of a cheek 11, located in the axis 39 for the heater 10 is the power input/output 13 which is formed by suitable, separate and directly juxtaposed contacts. The heater 10 is stationary and does not rotate with the tool 1. Between this cheek 11 and the working region of the tool 1 a driving gearwheel of the drive 14 torsionally connected to the latter is located.

The tool 1 comprises a dimensionally stable base body 15 or tubular shell 16 of constant wall thickness throughout, extending axially over more than the working width which with face end parts 17 rigidly connected to its ends and featuring bearing and drive trunnions forms the base body. The face end parts 17 close off the end openings of the sleeve 16 substantially tight with ring disk shaped plates and through a central passage of a face end part 17 the heater 10 passes through substantially non-contacting over the majority of the length of the passage.

The two outer and inner circumferential surfaces 18, 19, coupled to each other for good heat conduction, of the sleeve 16, the length of which determines the maximum working width, are cylindrical. The outer circumferential surface 18 includes retention means 20 extending thereupto at the most which form retention zones or retention surfaces in the circumferential surface 18 distributed in a regular pattern, each totally separate from the other. By means of several adjacent retention zones a working insert or plate is permanently held against the circumferential surface 18 by frictional contact during operation. The circumferential surface 18 is totally accessible at all times without removal from the frame 2 or transverse shifting of the tool 1 with respect thereto so that the plate can be applied, removed or replaced transversely to the circumferential surface 19 manually without necessitating further fitting work.

Each of the retention zones of the same size is defined circular throughout in the circumferential surface 18 around the circumference thereof and arranged in a regular pattern in lines parallel to the axis 39 as well as circumferentially equispaced by amounts which are smaller than the breadth or half width of a definition. The retention zones are uniformly distributed over the full length and the complete circumference of the shell 16.

Each retention zone or retention surface 24 is formed by a separate retention/magnet unit 22 having no contact with all the others, the axis 40 of which intersects the axis 39 at right angles or is located at right angles to the working zone or working surface 18. Each unit 22 contains a Al—Ni—Co magnet body 23 having a diameter of at least 10 and note more than 15 mm exposed only in the envelope or circumferential surface 18 and a length which as compared thereto is larger, for example, twice as large. The circumferential surface as well as the face 25 facing away from the retention face of the magnet body 23 are covered by a single, cup-shaped, integral shield 26 in close contact therewith, the outer circumference and associated face of which, again in close contact as a kind of pole plates, are covered by a single cup-shaped, integral pole intensifier 27 of soft or hard iron or the like. These sleevings 26, 27 connected to each other and to the magnet body 23 in full surface contact by pressure forming or the like are, like the magnet body 23, cylindrical throughout over each corresponding length, feature end surfaces and extend by their ring-shaped end faces up to the circumferential surface 18 from which they form a projection curved about the axis 38 throughout. These end faces of the parts 23, 26, 27 are coupled to the base body 15 for good heat conductivity and are heated by the heater 10.

Every preassembled unit 22 is arranged in a separate mount 21, namely a radial drilling configured integral with the base body 15 or the sleeve 16 which passes from the circumferential surface 18 with a constant breadth up to its bottom surface over a length which is roughly a third smaller than the thickness of the sleeve 16 so that the mount 21 does not pass through the circumferential surface 19 closed throughout. The cylindrical outer circumferential surface 28, constant over the full length of the preassembled unit 22, of the unit 22 or of the pole intensifier 27 forms together with the corresponding full length inner circumferential surface 29 of the mount 21 a gap, again over this length, which is constant throughout, of at least a half tenth and not more than a tenth of a millimeter in width which is filled with a locking means 30, such as a high-temperature adhesive, cement or the like. The bottom surface 31 of the mount 21 is in planar contact with the circumferential surface 28, 26 or the means 30 and has the shape of a ring having an inner ring diameter which is smaller with respect to the diameter of the magnet body 23 and forms an abutment surface for full-surface contact of the associated planar face 21 of the unit 22 or cover 27 respectively. The surfaces 31, 32 directly interengage so that between them substantially no means 30 is present. Connecting the bottom surface 31 or the inner ring definition thereof is a cavity or receiving space 33 free from the unit 22, this space being located in the axis 40 and which may include a radial passageway passing through the circumferential surface 19. The bottom surface of the retention surface 33 defined dish-shaped may be produced in a single operation by the tip, correspondingly ground, of the countersink or countermill producing the receiving drilling 21.

Before insertion of the unit 22 the means 30 is applied in fluid condition to the circumferential surface 28 and/or 29 in a quantity slightly more than needed to fill the gap, after which the unit 22 is inserted manually parallel to the axis 40 and, where necessary to distribute the means 30, with simultaneous back and forth rotary movements. This causes the excess means 30 to be displaced radially outwards into the space 33 and/or from the ring gap opening in the circumferential surface 18, until the surfaces 31, 32 come into contact with each other. Following insertion of all units 22, which initially protrude somewhat from the surface 18, the surfaces 18, 24 are cylindrically ground in common about the axis 39 and thus adapted to each other free of joints and offsets. Locking each unit 22 in position with respect to movements parallel to the axis 40 may also be achieved by means engaging transversely or radially to the axis 40 in the unit 22 and body 15 respectively, such as a locking pin or grub screw.

At least one processing unit 34 substantially smaller with respect to the surface 18, 24 as a whole is locked in position in full surface contact with the circumferential surfaces 18, 24 uninterruptedly by the anisotropic magnet 23 covered thereby within the cover field and coupled thereto for good heat conduction. The insert 34 comprises a maximally 0.3 mm thick base body 35 continuously closed throughout over its full surface extent, of ferromagnetic sheet metal, the relaxed flat condition of which may be manually adapted to the curvature of the circumferential surface 18, 24 and maintained in this curvature solely by the magnetic force of the magnets 23, i.e. including a coating or covering 36 on the plate side facing away from the circumferential surface 18. This covering 36 of silicone which is joined full-surface by a bonding joint to the associated plate surface of the base body 35 has initially a constant thickness of maximally 6 or 3 mm throughout and is then, for production of the letterpress plate pattern, machined only at the positions at which no impression of the paper web is intended, i.e. not belonging to the working region 37. The covering thickness of these remaining regions 38 which may directly adjoin the edges of the plate 35 located transversely and/or parallel to the working direction of the circumferential surface 18, is reduced by milling or some other machining process by more than the half of the thickness of the working region 37 so that the working region 37 not adjoining the stated edges of the plate 35 protrudes radially with respect thereto.

Due to the described configuration the insert 34 is safeguarded against lifting off exclusively by the magnetic field and against shifting along the circumferential surface 18 by the friction-positive surface connection to the circumferential surfaces 18, 24.

For additional, where necessary, positive locking of the insert 34 against movements parallel to the working direction 41 defining features 42 may be provided directly adjoining the cover field, determined by the insert 34, of the circumferential surface 18, each of the interengaging positive contact members 43, 44 of which may be configured integrally with the plate 35 or the sleeve 16. To form a positive locking member 43 configured as an insertion body or insertion strip the associated edge of the plate 35 may be downswept at an acute angle with respect to the internal surface 19 with or without the covering 36. An insertion opening 44 provided as a close fit for this positive locking member 43 is formed by an axial slot passing through the circumferential surface 18 spaced away from the surfaces 24 which is oriented correspondingly skew with respect to an axial plane of the axis 39 passing therethrough and passes through only the surface 18 or none of the units 22 or drillings 21. The edge member 43—at the front in the working direction 41—of the insert 34 is located at acute angle opening in the direction of axis 39 so that it is able to easily slide out of the openings 44 on lifting-off of the insert 34 despite having little clearance.

Even in the absence of these positive locking members 43, 44 the retention force of the means 20 may be completely sufficient for operation as explained so that the positive locking members 43 may be eliminated. The magnetic field of each magnet 23 has a preferred strongest extension in the direction of the axis 40, for example, by the crystalline structure of the magnetic material being oriented in this direction. By shielding 26 the spatial effect of the magnetic field is restricted and any undesirable magnetization of the tool or surrounding parts of the device is prevented.

The circumferential surfaces 18, 24 may be provided in the axial direction and circumferentially with a fine line pattern of closely juxtaposed, visually readily discernible microlines which permit a precise alignment of the insert 34 in each case. It is understood that all stated properties and effects may be provided precisely as described, merely substantially or roughly as described or also in a major departure therefrom. The tool is also suitable for cold application of coatings or, where required, with minor modifications, for cutting actions with stamping inserts, such as stamping plates which are to be secured to the base body 15 as described.

What is claimed is:

1. A tool for processing layer material by performing an operational relative motion between the layer material and said tool, said tool comprising:

a tool base body including a working zone for receiving at least one insert tool and defining a motion direction oriented parallel to said operational motion of said working zone, said tool base body being a rotary cylinder defining a central rotation axis, said working zone defining a circumferential support face around said rotation cylinder and said central rotation axis, and, retention means for replaceably holding and pulling the insert tool against said working zone by an adherence force, for exerting said adherence force said retention means including holding units located within said working zone and with respect to said working zone being axially distributed along said support face, each of said holding units being enveloped by a separate individual boundary defining a holding depression and transversely penetrating said support face, said boundary and said holding depression being fixedly included in said rotary cylinder, each of said holding units operationally generating and exerting said adherence force for adhering the insert tool against said support face, wherein along said central rotation axis said support face includes a plurality of face sections including individual face sections each made in one part, in a radial view on said support face each of said individual face sections being interposed only between two luxtaposed ones of said separate individual boundaries and directly connecting to both said two juxtaposed individual boundaries, all of said plurality of individual face sections being commonly made in one part and spaced from each other by said individual boundaries.

2. The tool according to claim 1, wherein in a direction oriented transverse to said motion direction and parallel to said working zone a plurality of holding units are provided which include juxtaposed holding units and juxtaposed holding depressions, said boundary of at least one of said depressions including a circumferentially face extending around said holding depression and dismountable only by materially destroying said boundary.

3. The tool according to claim 1, wherein said holding units are axially and circumferentially distributed in a substantially regular pattern over said working zone, each of said two juxtaposed individual boundaries separately including a continuous circumferential boundary face, in a view transverse to said working zone substantially each one of said circumferential boundary faces of said individual boundaries being circumferentially entirely made in one part with said tool base body.

4. The tool according to claim 1, wherein said holding units are positionally separated and distributed in a pattern substantially entirely over said support face, each of a plurality of said holding units being circumferentially bounded by an individual bore including said boundary and traversing said support face to thereby define a plurality of individual bores, said support face being defined by an outermost cylindrical body surface of said tool base body, said boundaries of said plurality of individual bores (21) being commonly made in one part and spacedly juxtaposed along said support face.

5. The tool according to claim 1, wherein said individual boundaries are directly but spacedly juxtaposed in a direction transverse to said motion direction, between said juxtaposed individual boundaries said working zone including said support face for directly supporting the insert tool, in a view transverse to said working zone (18) said support face circumferentially, separately and entirely enveloping at least two of said juxtaposed individual boundaries in one part.

6. The tool according to claim 1, wherein said support face operationally and directly supports the insert tool, said support face being made from a hardenable material hardened by tempering, within each of said holding depressions said holding units including one of a plurality of individual magnet units, each of said magnet units defining a magnetic face section of said support face.

7. The tool according to claim 1, wherein at least one of said holding units includes a magnet unit inserted into said holding depression in a direction transverse to said support face, in a view transverse to said support face said individual boundary circumferentially entirely enveloping said magnet unit in one part, said individual boundary being made in one part with said rotary cylinder.

8. The tool according to claim 1, wherein at least one of said holding units includes a preassembled individual magnet unit defining remote magnet poles and a single central magnet axis, said magnet poles being penetrated by said magnet axis, said magnet axis being oriented transverse to said support face, in a view transverse to said support face said individual magnet unit including an outer circumferential magnet face defining a largest width extension and extending around said magnet axis, said individual magnet unit defining a length extension oriented transverse to said support face and larger than said largest width extension.

9. The tool according to claim 1, wherein at least one of said holding units includes a cylindrical magnet unit defining a magnet and cylinder axis, said magnet and cylinder axis transversely penetrating said support face.

10. The tool according to claim 1, wherein said individual boundaries are juxtaposed and evenly distributed over said support face, in a view transverse to said working zone each of said individual boundaries being concavely curved in one part, each of said holding units being individually and separately bounded by a single one of said individual boundaries, in said view each of said individual holding units being substantially circular.

11. The tool according to claim 1, wherein said individual boundary connects to said support face at an angle, within said individual boundary an individual one of said holding units including at least one sleeve member, in a view transverse to said support face said sleeve member entirely enveloping said holding unit and being circumferentially made in one part, said sleeve member being a component separate from said individual boundary and said rotary cylinder.

12. A tool for processing layer material by performing an operational relative motion between the layer material and said tool, said tool comprising:

a tool base body including a working zone for receiving at least one insert tool and defining a motion direction oriented parallel to said operational motion of said working zone, said working zone including a support face for operationally supporting the insert tool, retention means for replaceably holding and pulling the insert tool against said working zone by an adherence force, for exerting said adherence force said retention means including at least one holding unit located within said working zone and set back with respect to said working zone, said holding unit being enveloped by a boundary defining a holding depression and penetrating said working zone, said boundary connecting to said support face at an angle, within said boundary at least one sleeve member being provided, in a view transverse to said support face said at least one said sleeve member being circumferentially made in one part, and, means for processing the layer material with the insert tool at temperatures, and for withstanding the temperatures, which in the vicinity of said retention means and said working zone can reach at least 100° C. to 120° C., wherein said holding unit includes a magnet body circumferentially enveloped by said at least one sleeve member.

13. A tool for processing layer material by performing an operational relative motion between the layer material and said tool, said tool comprising:

a tool base body including a working zone for receiving at least one insert tool defining a motion direction oriented parallel to said operational motion of said working zone;

retention means for replaceably holding and pulling the insert tool against said working zone by an adherence force, for exerting said adherence force said retention means including at least one holding unit located within said working zone and set back with respect to said working zone, said holding unit being enveloped by a boundary defining a holding depression and penetrating said working zone, and, means for processing the layer material with the insert tool at temperatures, and for withstanding the temperatures, which in the vicinity of said retention means and said working zone can reach at least 100° C. to 120° C., wherein said holding unit includes a magnet unit including a magnet body including peripheral faces, said peripheral faces including a back side remote from said working zone and a circumferential face connecting to said back side and a front side at marginal circumferential zones, at least one of said peripheral faces being covered with a magnetic pole intensifier for intensifying the magnetic field at said front side, said front side being located remote from said back side in the vicinity of said working zone.

14. The tool according to claim 13, wherein said back side and said circumferential face are commonly covered in one part circumferentially entirely over said circumferential face and said marginal zone of said back side, said holding unit including said magnet body and said pole intensifier to thereby define a preassembled unit, means being provided for assembling said preassembled unit with said tool base body by inserting said preassembled unit into said holding depression.

15. The tool according to claim 13, wherein said circumferential face is directly covered with a non-magnetizable magnet cover directly covered by said pole intensifier, said magnet cover and said pole intensifier providing coaxial sleeves, thereby providing a preassembled anisotropic magnet unit.

16. The tool according to claim 1, wherein said retention means includes at least one preassembled magnet unit operationally resistant up to a Curie temperature of at least 200° C. to 300° C., said magnet unit including a single permanent magnet only, said magnet unit including a sleeve unit circumferentially closely enveloping said permanent magnet, at said support face said sleeve unit not covering said permanent magnet.

17. The tool according to claim 1, wherein a magnet body (23) is inserted inside said holding depression (21) and includes at least one of: aluminum, nickel, cobalt, iron, copper, titanium, samarium, neodym and barium; and, in a view transverse to said support face said magnet body defining a largest first width extension and a second width extension oriented perpendicular to said first width extension, said first and second width extensions being substantially equal.

18. The tool according to claim 1, wherein said holding unit includes a magnet unit inserted into said holding depression in a direction transverse to said working zone, remote from said working zone said holding unit including a unit back face defining a first surface, only part of said unit back face being rigidly abutted against a counterface of said tool base body, said counterface defining a central face axis oriented transverse to said support face, said counterface (31) and said part of said back face extending entirely around said central face axis, said counterface defining a second surface smaller than said first surface.

19. The tool according to claim 1, wherein said holding unit includes a permanent magnet body defining a central magnet axis within a unit circumference of said holding unit, said permanent magnet body and said unit circumference being rigidly connected to said tool base body without radial motion play, between said unit circumference and said individual boundary a connecting envelope circumferentially entirely enveloping and rigidly connecting said unit circumference to said tool base body, said connecting envelope being circumferentially entirely made in one part and being open radially outwardly with respect to said central rotation axis.

20. The tool according to claim 1, wherein spaced from said working zone said holding depression continues into a reception chamber for receiving superfluous amounts of a bonding agent rigidly connecting said holding unit with said tool base body at a distance from said reception chamber, said reception chamber connecting to an end face of said holding unit, means being included for pressing said superfluous amounts into said reception chamber while forcing said holding unit into said holding depression.

21. A tool for processing layer material by performing an operational relative motion between the layer material and said tool, said tool comprising:

a tool base body including a working zone for receiving at least one insert tool and defining a motion direction oriented parallel to said operational motion of said working zone;

at least one insert tool;

retention means for replaceable holding and pulling the insert tool against said working zone by an adherence force, for exerting said adherence force said retention means including at least one holding unit located within said working zone, said holding unit being enveloped by a boundary defining a holding depression and penetrating said working zone, and, means for processing the layer material with the insert tool at temperatures, and for withstanding the temperatures, which in the vicinity of said retention means and said working zone can reach at least 100° C. to 120° C., wherein said insert tool includes a flexible base plate for operationally directly supporting against said tool base body, said base plate bearing an elastomeric layer including a working zone for engaging the layer material.

22. The tool according to claim 21, wherein said insert tool includes at least one locking member of said base body.

23. A tool for processing layer material by performing an operational relative motion between the layer material and said tool, said tool comprising:

a tool base body including a working zone for receiving at least one insert tool and defining a motion direction oriented parallel to said operational motion of said working zone;

retention means for replaceable holding and pulling the insert tool against said working zone by an adherence force, for exerting said adherence force said retention means including at least one holding unit located within said working zone and set back with respect to said working zone, said holding unit being enveloped by a boundary defining a holding depression and penetrating said working zone, wherein means are provided for processing the layer material with the insert tool at temperatures, and for withstanding the temperatures, which in the vicinity of said retention means and said working zone can reach at least 100° C. to 120° C., said tool including heating means for operationally heating said working zone.

24. The tool according to claim 1, wherein said rotary cylinder includes a hollow cylinder sleeve penetrated by a plurality of said individual boundaries and enveloping an internal space, said internal space being coaxial with said central rotation axis and being bounded by an inner wall surface of said cylinder sleeve made in one part, remote from said inner wall surface said cylinder sleeve including said support face, said support face defining an overall width extension oriented parallel to said central rotation axis, said internal space extending substantially over said overall width extension, said individual boundaries being made in one part with said cylinder sleeve and being separately distributed along said central rotation axis with said individual face sections interposed between said individual boundaries.

25. The tool according to claim 1, wherein said rotary cylinder operationally rotates about said central rotation axis, an outermost circumference of said rotary cylinder providing said support face, said holding units being substantially evenly distributed over substantially entirely said outermost circumference and including spacedly juxtaposed holding units, each of said holding units being inserted in a separate said holding depression, said individual face sections being interposed between said juxtaposed holding units and continuing in one part around each of said juxtaposed holding units.

* * * * *